United States Patent [19]

Silva

[11] 4,306,539

[45] Dec. 22, 1981

[54] FURNACE DRAFT HOOD WITH OUTSIDE AIR SUPPLY

[76] Inventor: René N. Silva, 555 Cliff St., Ridgewood, N.J. 07450

[21] Appl. No.: 168,690

[22] Filed: Jul. 11, 1980

[51] Int. Cl.[3] ..... F23J 11/00

[52] U.S. Cl. ..... 126/312; 98/48; 126/307 A

[58] Field of Search ..... 126/293, 307 A, 312; 98/48, 119

[56] References Cited

U.S. PATENT DOCUMENTS

| | | | |
|---|---|---|---|
| 2,017,562 | 10/1935 | Brown | 126/312 X |
| 2,090,053 | 8/1937 | Kuenhold | 126/307 A |
| 2,264,547 | 12/1941 | Olds | 126/307 A |
| 4,118,173 | 10/1978 | Shakiba | 98/119 X |
| 4,187,833 | 2/1980 | Zahora et al. | 126/312 |

*Primary Examiner*—Albert J. Makay
*Assistant Examiner*—Harold Joyce
*Attorney, Agent, or Firm*—Brooks, Haidt, Haffner & Delahunty

[57] ABSTRACT

A heater venting system in which a draft hood which connects at its upper end to a chimney, which has an open lower end and which has an opening intermediate its upper and lower ends connected to the heater exhaust flue has its open lower end connected for gas flow to a chamber which is open to the building inside air at its upper end and which is connected at its lower end to air outside the building by a damper controlled duct to provide an inside air-outside air interface at, or above the lower end of the hood to restrict the flow of building inside air into the hood.

12 Claims, 7 Drawing Figures

FURNACE DRAFT HOOD WITH OUTSIDE AIR SUPPLY

This invention relates to venting apparatus for venting combustion gases from heating systems and particularly, to venting apparatus for gas-fired or oil-fired furnaces which reduces the loss of heated air from the place where such a furnace is located.

Although the invention will be described in connection with a gas-fired furnace, the invention may also be used with other types of furnaces, such as oil-fired furnaces, which produce combustion products which are vented to the atmosphere. The manner in which the heat of the furnace is conveyed to other areas is unimportant for the purposes of the invention, e.g., the heat may be conveyed by steam, water or air.

Gas-fired furnaces typically are provided with a flue which extends from the furnace to a device known as a draft hood, or draft diverter, which has an opening at its lower end through which heated air from the room in which the furnace is located is drawn, such heated air being mixed with the flue gases and conveyed by a further flue to a chimney which opens to the atmosphere. The withdrawal of heated air from the room represents a loss of heat to the atmosphere and hence, a waste of heat. Such an opening in the furnace flue system has had the approval of the gas industry because of the following advantages:

(a) In case of a down draft through the chimney, for example, on a windy day, and if the flue system does not have the opening, the full blast of the wind may blow out the pilot light for the gas burner or, what is worse, may blow out the flame of the burner if the heater is on. However, with the opening, most of the blast of the down draft wind will dissipate in the heater room by way of the opening and the full force of the wind will not reach the inside of the furnace.

(b) The opening is always located at the lower part of the draft hood. If there is any gas leakage in the furnace itself, it will follow a path through the flue to the chimney by flowing through the upper part of the hood. In this case, any accumulation of gases within the furnace and/or the furnace room is avoided.

(c) The furnace may operate without any draft provision other than that provided by the design of the equipment itself.

(d) The air from the furnace room may be added to the flue gases to reduce their dew-point.

Various systems have been devised for the purposes of attempting to reduce the removal of heated furnace room air by way of the furnace. See, for example, U.S. Pat. Nos. 2,274,341; 2,619,022; 2,711,683; and 4,185,769. Generally speaking, such systems are not completely satisfactory because of the complexity of the installations, making them unsuitable for simple retro-fitting of existing furnace installations, becaue they do not include the draft hood described hereinbefore with its advantages, because they eliminate the draft hood advantages and/or because they reduce loss of heated furnace room air only when the furnace burner is not operating.

One object of the invention is to provide venting apparatus for a furnace installation which reduces the loss of heated furnace room air whether or not the furnace burner is operating.

Another object of the invention is to provide venting apparatus which can be used with either gas-fired or oil-fired heaters.

Another object of the invention is to provide the automatic addition of drier air to the combustion products supplied to the chimney, under certain conditions, so as to reduce condensates within the chimney.

A further object of the invention is to provide venting apparatus which not only permits the use of the conventional draft hood with its advantages but also improves the safety thereof by diverting at least some of the chimney down draft air outside the building in which the furnace is located.

A still further object of the invention is to meet the objectives set forth hereinbefore with apparatus which is relatively simple and inexpensive, which can be added readily to existing furnace installations and which does not have parts which must move during the reduction of heat loss and hence, which can wear out or become inoperable.

Other objects and advantages of the present invention will be apparent from the following detailed description of the presently preferred embodiments thereof, which description should be considered in conjunction with the accompanying drawings in which.

Figure 1:
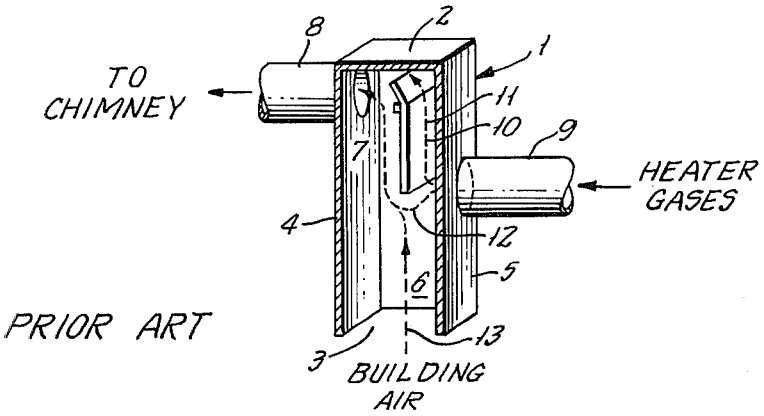
FIG. 1 is a diagrammatic, perspective view, partly in cross-section, of a conventional draft hood used to connect a gas heater or furnace to a chimney.

The apparatus illustrated in FIG. 1 is a conventional form of draft hood 1 often used to connect a gas furnace to a chimney and is of the type described hereinbefore. The hood 1 has a top wall 2, an open bottom 3 and four side walls, the walls 4, 5 and 6 being shown in FIG. 1. The hood 1 has an upper opening 7 which is connected to a chimney (not shown) by a flue 8 so as to exhaust gases from the hood 1 to the atmosphere outside a building. The hood 1 has another opening below the opening 7 to which the gas furnace is connected by a flue 9 for conveying gaseous products of combustion from the furnace into the hood 1.

A baffle or diverter 10 in the form of an angled plate is mounted in a fixed position within the hood 1 in line with the opening 7 and also extends downwardly a distance sufficient so that at least part of the diverter 10 is in line with the opening to which the flue 9 is connected. The purpose of the diverter 10 is to reduce the effect of chimney downdrafts on the furnace by diverting part of the downdraft air out of the bottom opening 3, and the purposes of the hood 1 have been described hereinbefore.

During normal operation, that is, in the absence of reverse flow of air by way of the flue 8, gaseous combustion products, when the furnace is operating to heat, or air, when the furnace is not operating, will flow from the furnace through the hood 1 as indicated by the dotted lines 11 and 12 in FIG. 1. When the furnace is not operating to heat, heated building air flows into the hood along the path indicated by the dotted line 13 and is vented to the atmosphere, thereby causing a waste of heat. One of the main purposes of the invention is to reduce the loss of heated building air when the furnace is not operating. However, as described hereinafter, building air is vented by way of the hood 1 with the apparatus of the invention when it is cooler than the outside air.

Figure 2:
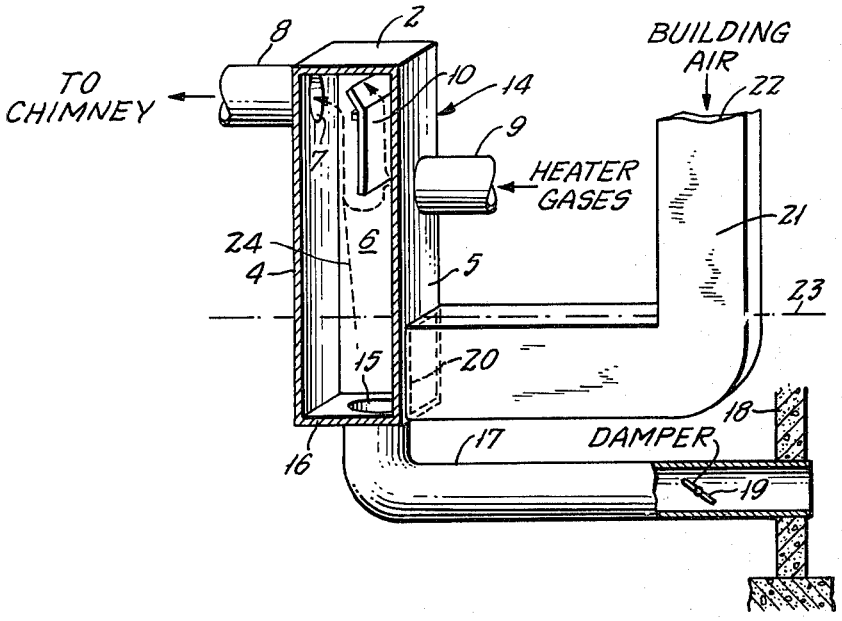
FIG. 2 is a similar to FIG. 1 but illustrates the principles on which the invention is based and shows the modifications required for use of the invention.

FIG. 2 illustrates the principles of the invention although, for the reasons set forth hereinafter, FIG. 2 does not illustrate a preferred embodiment of the invention. The apparatus of the invention comprises an enclosure 14 which is, in effect, an extended form of the hood 1 and includes a diverter 10, an opening 7 communicating with the chimney flue 8 and an opening communicating with the heater or furnace flue 9. It also has a top wall and four side walls, the walls 4–6 being shown. Although the enclosure 14 has a bottom opening 15 in a bottom wall 16, the opening 15 does not open into the interior of the building. Instead, air from outside the building is supplied to the opening 15 by way of a duct 17 which extends to the exterior of the building, an exterior wall of the building being designated by the reference numeral 18. A butterfly type damper 19 is disposed in the duct 17 for controlling the supply of outside air to the opening 15 and hence, to the interior of the enclosure 14.

The enclosure 14 also has a further opening 20 in the side wall 5 and above the opening 15 to which the lower end of a duct 21 is connected, the duct 21 extending upwardly, having an opening 22 at its upper end which opens to the air in the building and having a cross-sectional area similar to the horizontal cross-sectional area of the enclosure 14. Preferably, the opening 22 is higher than the flues 8 and 9, and it need not be as explained hereinafter. Thus, building inside air is supplied to interior of the enclosure 14 by way of the duct 21 at an opening 20 which is above the opening 15 to which air from outside the building is supplied.

With the apparatus illustrated in FIG. 2, the objective is to fill the lower part of the enclosure 14 and the lower part of the duct 21 with cooler air from outside the building when the air which is within the building and which is at the opening 22 is heated, or has a temperature higher than the temperature of the outside air. Thus, the objective is to provide a warm air-cold air interface 23 which, at least when the furnace is not operating, prevents air inside the building from entering the enclosure 14. Of course, the openings 15 and 20 function in the same manner as the opening 3 (FIG. 1) whenever down drafts occur.

The level of the interface 23 is determined by the setting of the damper 19, and should be at least as high as the upper edge of the opening 20 but below the level of the opening 22. Thus, the opening 22 is at least as high as as the selected level of the interface 23 to prevent cooler outside air from flowing into the building by way of the opening 22. Accordingly, the opening 22 must be at least as high as the upper edge of the opening 20. By opening the damper 19 further, the level of the interface 23 is raised and by closing the damper 19 more the level of the interface 23 is lowered. With a duct 17 of sufficient size and with the damper 19 fully open cold air will flow into the building by way of the duct 21 and the opening 22, and with the damper 19 fully closed, no outside air will reach the enclosure 14. On an experimental basis, the level of the interface 23 can be determined by extending a plurality of temperature measuring devices, such as thermometers, through a side wall of the enclosure 14 at different levels to determine the temperature at different levels with the furnce not operating. A simpler, although less accurate way, to determine whether or not the damper 19 is properly set is to determine whether or not building air is flowing into the opening 22, when the furnace is not operating, by means of visible smoke projected toward the opening 22.

Accordingly, when the interface 23 is properly set by adjustment of the damper 19 and when the furnace is not operating, air from the furnace will be vented to the atmosphere by way of the duct 9 and the enclosure 14. Air will also be drawn from the lower part of the enclosure 14 along the path 24, but all, or substantially all, of such latter air will be outside air supplied by way of the duct 17 rather than heated, inside of the building air. Therefore, heated building air is not vented to the atmosphere as is the case with the prior art illustrated in FIG. 1.

When the furnace is operating, the flow of air along the path 24 is increased which means that if the damper 19 is maintained in the position thereof appropriate to prevent venting of building air when the furnace is not operating, the interface 23 will lower causing some flow of building inside air into the enclosure 14 and to the atmosphere, but such loss is relatively small. It is, of course, possible to use conventional controls which would turn the damper 19 when the furnace is set into operation so that the flow of outside air by way of the duct 17 would increase and which would return the damper 19 to the desired position when the furnace stops operating. However, the added expense and complications are not necessary in view of the small loss of building air when the furnace is operating.

Figure 3:
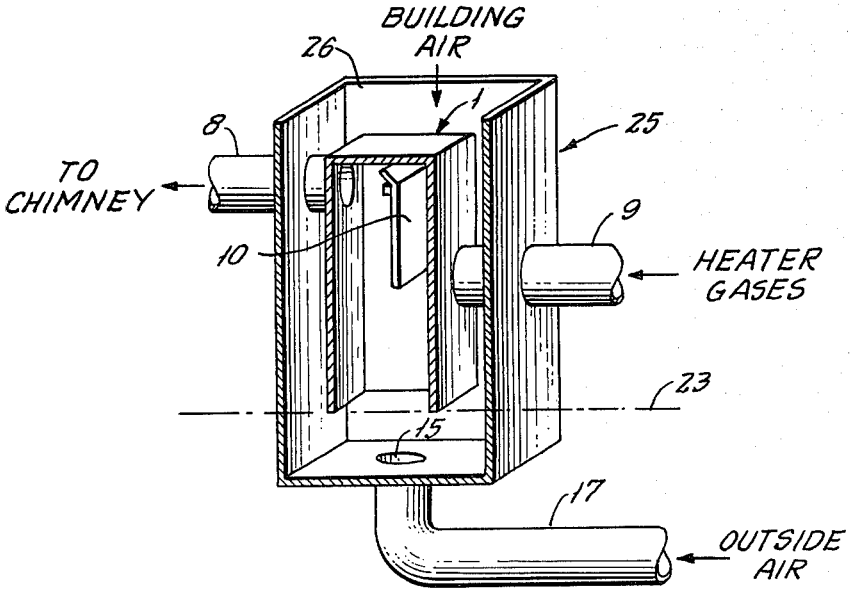
FIG. 3 is similar to FIG. 2 and shows a modified form of the apparatus illustrated in FIG. 2.

FIG. 3 is an embodiment of the invention in which the duct 21 shown in FIG. 2 is replaced by a multi-walled container 25 which extends around the side walls and the bottom of the hood 1. The embodiment shown in FIG. 3 functions in the manner described in connection with FIG. 2, the container 25 substituting for the duct 21. The container 25 has an opening 26 which corresponds to the opening 22 and through which building inside air flows when the level of the cooler outside air, supplied through the opening 15 is not at least as high as the interface plane 23. Thus, as long as the interface 23 is at least as high as the bottom of the hood 1, heated building air does not flow into the hood 1 in any significant amount.

The embodiment illustrated in FIG. 3 has the further advantage that air between the walls of the container 25 and the walls of the hood 1 is heated by the exhaust gases of the furnace when the furnace is in operation. Such latter heated air flows into the building thereby extracting useful heat from the furnace gases which would otherwise be lost to the atmosphere. In addition, such heated air, since it flows upwardly out of the top of the container 25, aids in maintaining the interface 23 above the bottom, open end of the hood 1, thereby avoided the loss of heated building air into the hood 1 when the furnace is operating.

The embodiment illustrated in FIG. 3 is satisfactory when there is adequate space for a container 25 which extends around the hood 1 and when it is not necessary to keep costs to a minimum. The embodiment of the invention illustrated in FIG. 4 has substantially all of the advantages of the embodiment illustrated in FIG. 3 but requires less space and is less costly.

Figure 4:
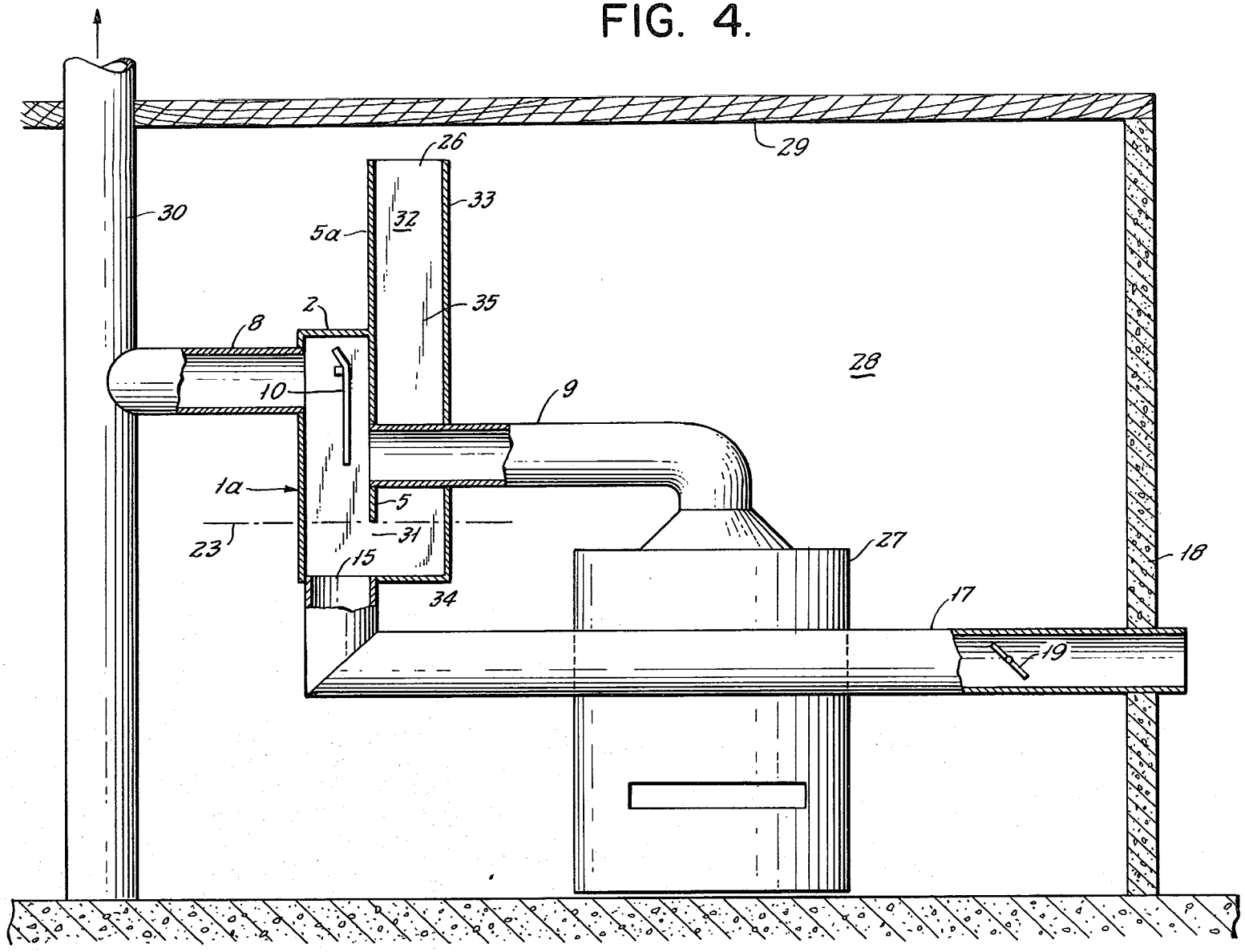
FIG. 4 is a side elevation, diagrammatic view, partly in cross-section, of a preferred embodiment of the invention in association with a furnace within a room in a building.

FIG. 4 shows schematically the apparatus of the invention in association with a furnace 27 in a room 28 of a building having an outside wall 18 and a ceiling 29. The flue 8 is connected to a chimney 30 which vents the furnace gases to the atmosphere. The hood 1 is modified as indicated at 1*a* so that the bottom thereof receives outside air through the opening 15 and to provide an opening 31 at the lower end of the side wall 5. The side wall 5 is extended upwardly, at 5*a*, and three side walls, side walls 32 and 33 appearing in FIG. 4, and a bottom wall 34 are added to form a chamber 35 which has, as part of one wall thereof, the hood wall 5. In this way, the air in the chamber 35 is heated when the furnace 27 is in operation and provides the advantages described in connection with FIG. 3.

Figure 5:
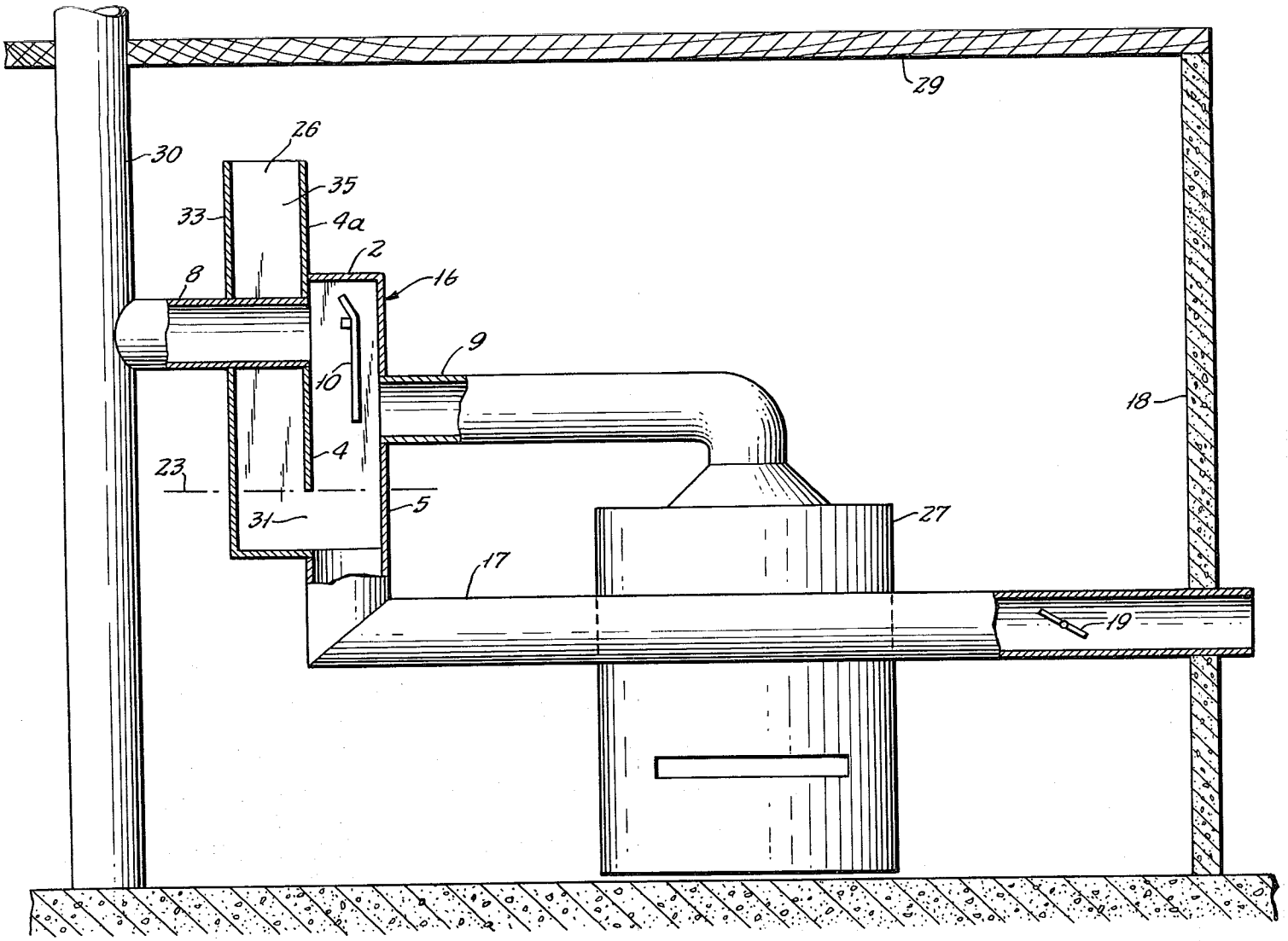
FIG. 5 is similar to FIG. 4 and illustrates a modified embodiment of the invention.

FIG. 5 illustrates an embodiment of the invention similar to the embodiment illustrated in FIG. 4 except that the position of the chamber 35 is at the opposite side of the hood 1*b*.

Figure 6:
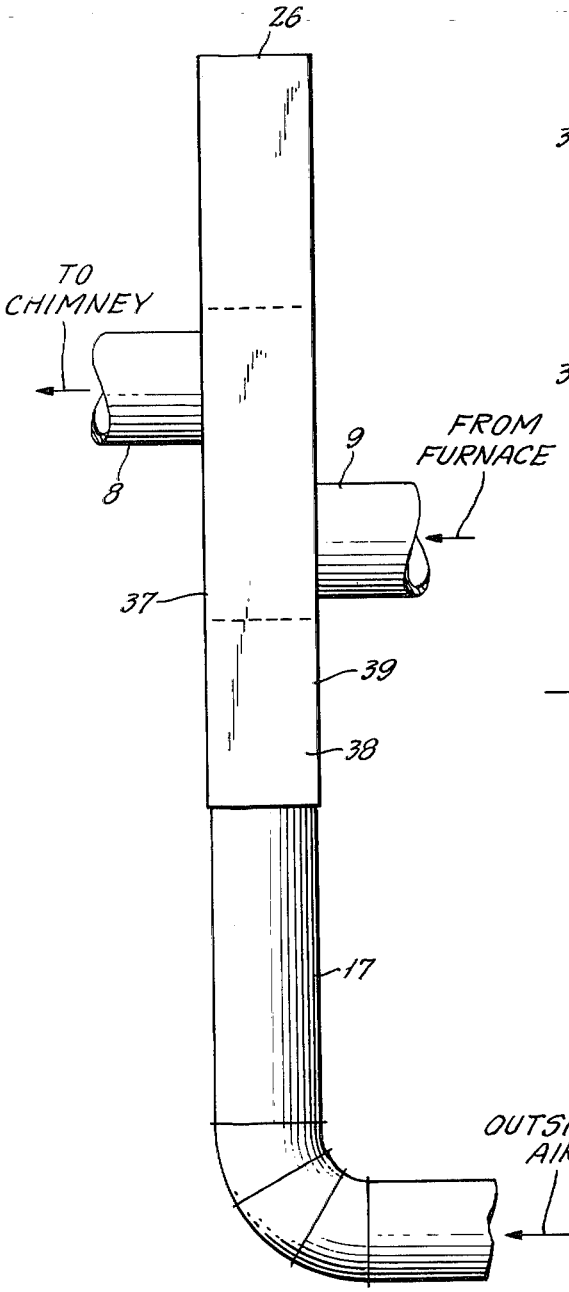
FIGS. 6 and 7 are respectively side elevation and front elevation views, the latter partly in cross-section, of a further modified embodiment of the invention.
Figure 7:
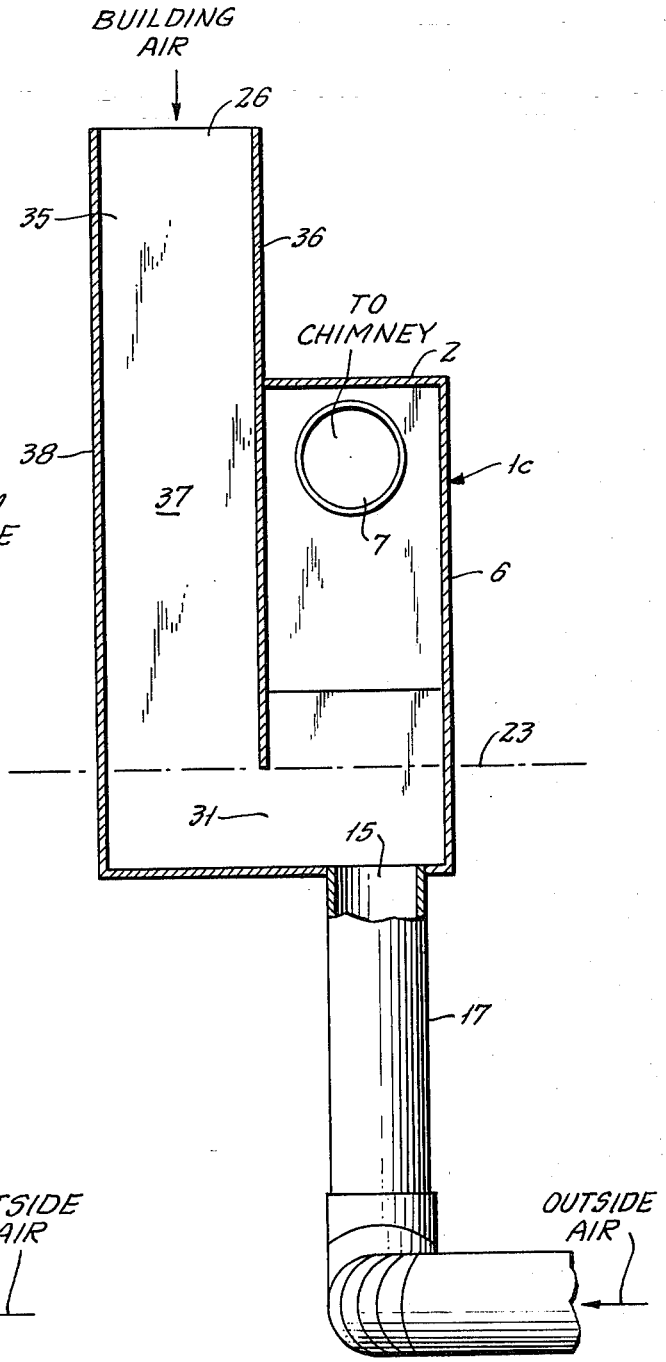

FIGS. 6 and 7 illustrate an embodiment of the invention in which the chamber 35 is at one side of the hood 1*c* rather than at the front or back thereof as illustrated respectively in FIGS. 4 and 5. The chamber 35 has a side wall 36, part of which is also a side wall for the hood 1*c* and three other side walls 37, 38 and 39. The chamber 35 has an opening 26 at its top which permits the entrance of building inside air into the chamber 35 and has an opening 31 at its bottom for the exchange of air between the chamber 35 and the hood 1*c*.

While not intending to be bound to a theory of operation of the apparatus of the invention, experiments with apparatus of the type illustrated in FIGS. 6 and 7 have shown that with proper adjustment of the damper 19 in the duct 17, the flow of building inside air into the hood 1*c*, when the furnace is not operating and when the outside air is cooler than the inside air, can be reduced to zero without causing outside air to enter the building by way of the duct 17 and the opening 26. Since the density of air varies with temperature, and since the column of warmer air in the chamber 35 and the column of cooler air may be considered as having heights which are approximately the same, at the apparatus of the invention, the pressure of the outside cooler air is greater than the pressure of the inside warmer air which makes it possible to provide an inside air—outside air interface 23 within the hood 1*c* and the chamber 35 by adjusting the pressure drop across the damper 19.

During the summer, when the outside air is warmer than the inside air, the apparatus of the invention is advantageous in that the interface 23 will lower permitting building inside air, having a relative high humidity, to flow into the hood 1*c* and be vented to the atmosphere. Such venting will take place in substantial amounts if the furnace is operating, such as by reason of the heating of water when the furnace is a combined building and water heater.

The use of damper 19 during the summer will depend on several factors including the amount of humidity in the basement and the temperature inside and outside of the house or building. For a humid basement, it is recommended that the damper 19 be closed in order to eliminate the basement air and its humidity by way of the chimney. For a dry basement and on a hot day, when the outside temperature is higher than the basement temperature but lower than the house temperature, the damper 19 should be opened completely to allow outside air to be fed to the chimney 9 instead of the colder air in the basement. In this way, the colder air in the basement will not be replaced by the hotter outside air and the basement will be kept colder.

As a practical example of the operation of the apparatus of the invention, let it be assumed that the furnace includes a steam boiler, has a heat exchanger for heating water supplied to hot water faucets and burns utility supplied gas. In this case typical operating temperatures would be as follows:

| Conditions | Flue gas temperature in Advance of the draft hood | Outside Temperature |
|---|---|---|
| Winter time, heater OFF, about | 200° F. | 20° F. |
| Winter time, heater ON, about | 500° F. | 20° F. |
| Summer time, heater OFF, about | 100° F. | 80° F. |
| Summer time, heater ON about | 385° F. | 80° F. |

Under winter conditions and with the furnace 20 off, the temperature inside the furnace is the temperature of the water inside the boiler section of the furnace, or about 210° F. as an average. Therefore, the gas going through the furnace is actually the air from the furnace room (at about 67° F.) heated to about 200° F. as an average. There is a pilot light which is not taken into consideration in this evaluation. This air, heated to about 200° F., will ascend through the furnace 27, flow through the flue 9, until it reaches draft hood 1, 1*a*, 1*b* or 1*c* where it will mix with the outside air at 20° F. which is coming through duct 17 and draft hood bottom opening. The mixed gases will exit the draft hood through the flue 8 at about 80° F. and flow through the chimney 30 to the atmosphere.

When the same furnace is on, under the same conditions as stated above, except for a flue 9 temperature of 500° F. and a chimney temperature of about 195° F., the interface will drop down to the height of the draft hood bottom opening. This is due to the increase in the flue gas temperature at the flue 9, from 200° F. to 500° F. which will increase the temperature of the mixture going up the chimney 30 to about 195° F. This increase in temperature will increase the upward velocity of the gases and therefore, will draw more air. As explained above, the damper 9 was regulated to let a measured amount of cold air to flow into the system to keep the interface 23 of cold air and warm air maintained between draft hood extension opening 26 and draft bottom opening, when the heater was off. Therefore, if the drawing of air is increased, but the supply of cold air is not, the interface 23 will be lowered until some warm room air will start leaking toward the chimney 30 through the draft hood bottom opening in order to make up for the increased demand in air supply. At this point some air from the furnace room is lost to the chimney, but this loss is very small and happens only when the heater is on.

It will be noted from the foregoing description of the invention that the apparatus of the invention eliminates, or substantially eliminates, the loss of heated air from the building by way of the bottom of the draft hood, both when the furnace is on or off. However, building air is drawn through the furnace 27 and the flue 9 and passes up the chimney when the furnace is on or off. To eliminate the loss of air from the building by way of the furnace 27 when the furnace is not operating, the apparatus of the invention may be used in conjunction with an automatic damper in the flue 9 which blocks the flue 9 when the furnace is off. Such an automatic damper is illustrated and described in U.S. Pat. No. 4,185,769, but the use of such a damper eliminates some of the advantages of the invention, namely, lack of moving parts and the features of a draft hood described hereinbefore. Furthermore, with a draft hood and without such an automatic damper, the apparatus of the invention eliminates heat losses by way of the draft hood when the furnace is not operating and substantially eliminates such losses when the furnace is operating whereas the automatic damper prevents heat losses only when the furnace is not operating and does not prevent them when the furnace is operating.

The invention is applicable to oil-fired heaters having a partially or continuously vented flue or having a shut-off, butterfly valve in the flue activated by an automatic mechanism. When the flue of the oil-fired heater is continuously vented, the operation is as described in connection with a gas-fired heater. Where the flue of the oil-fired heater has such a butterfly valve which closes when the heater is off and opens when the heater is on, heat losses will not occur when the valve is closed.

Although preferred embodiments of the present invention have been described and illustrated, it will be apparent to those skilled in the art that various modifications may be made without departing from the principles of the invention .

I claim:

1. A venting system for venting gases from a heater located within a building to the outside of the building, said system comprising:

a chimney duct extending to the outside of the building; hood means having walls forming a first chamber having an upper opening, a lower opening and a further opening above the lower opening;

gas conveying means connecting said heater to said further opening for the flow of gases from the heater into said chamber;

gas conveying means connecting said upper opening to the chimney duct for the flow of gases from said chamber to said chimney duct and thence, outside the building;

further means forming a second chamber having an upper opening and a lower opening, said further means being disposed with its lower opening in gas communication with the lower end of said hood means and with its upper opening above its lower opening and exposed to air within the building; and further duct means extending from adjacent the lower opening in said hood means to the exterior of the building for supplying air from exteriorly of the building to the chamber of said hood means, whereby an outside air-inside air interface may be provided at said lower end of said hood means which restricts the flow of air from inside the building into the chamber of the hood means.

2. A venting system as set forth in claim 1 further comprising a gas diverter within the first chamber and intermediate said upper opening of said first chamber and said further opening of said first chamber for preventing the flow of gas in a straight line between said last-mentioned upper opening and said further opening.

3. A venting system as set forth in claim 1 further comprising adjustable damper means connected to said further duct means for adjusting the flow of air from exteriorly of the building into said hood means.

4. A venting system as set forth in claim 1, 2 or 3 wherein said further means comprises a multi-walled enclosure having side walls adjacent to but spaced from side walls of said hood means and having a bottom wall below and spaced from the lower opening in said hood means, said bottom wall having an opening therein to which said further duct is connected.

5. A venting system as set forth in claim 4 wherein said upper opening in said second chamber is above said upper opening in said first chamber.

6. A venting system as set forth in claim 1, 2 or 3 wherein said further means comprises at least one wall joined to said hood means so that one wall of said hood means forms a side wall of said second chamber and comprises a bottom wall below and spaced from said one wall of said hood means to provide said lower opening in said further chamber, said bottom wall having an opening therein to which said further duct is connected.

7. A venting system as set forth in claim 6 wherein said upper opening in said second chamber is above said upper opening in said first chamber.

8. Apparatus for reducing the loss of heated air from a building in which a heater is installed, said apparatus comprising:

a multi-walled hood, the walls of which define a first chamber with an open lower end, with an upper opening at its upper end for the passage of gases to a chimney and with a further opening intermediate the upper opening and said lower end for receiving gases from a heater; and further multi-walled means forming a second chamber adjacent said hood, a wall of said further means being below and spaced from the lower end of said hood to provide a gas passageway between said second chamber and said first chamber, said second chamber having an opening therein above said passageway and said last-mentioned wall also having an opening therein for receiving outside air.

9. Apparatus as set forth in claim 8 wherein said further means has at least one wall extending around and spaced from the sides of said hood.

10. Apparatus as set forth in claim 8 wherein a wall of said hood forms one wall of said second chamber.

11. Apparatus as set forth in claim 9 or 10 wherein said opening in said second chamber is above the upper opening in said first chamber.

12. Apparatus as set forth in claim 11 further comprising a gas diverter in said hood spaced from said further opening and said upper opening in said hood and intercepting a straight line extending between said further opening and said upper opening in said hood.

* * * * *